US006305024B1

(12) United States Patent
Schweer

(10) Patent No.: US 6,305,024 B1
(45) Date of Patent: Oct. 23, 2001

(54) HUNTING GARMENT WITH SAFETY DEVICE

(76) Inventor: James R. Schweer, 521 N. Lake Cove, Birmingham, AL (US) 35242

( * ) Notice: Subject to any disclaimer, the term of this patent is extended or adjusted under 35 U.S.C. 154(b) by 0 days.

(21) Appl. No.: 09/782,066

(22) Filed: Feb. 14, 2001

Related U.S. Application Data

(60) Provisional application No. 60/238,450, filed on Oct. 10, 2000.

(51) Int. Cl.[7] ..... A41D 13/00; A62B 35/00

(52) U.S. Cl. ..... 2/94; 2/69; 2/108; 182/3

(58) Field of Search ..... 2/94, 69, 69.5, 2/79, 102, 44–45, 81, 327, 108, 93, 456; 182/3–6; 244/151 R

(56) References Cited

U.S. PATENT DOCUMENTS

| | | | | |
|---|---|---|---|---|
| 1,845,099 | * | 2/1932 | Popelakova | 244/151 R |
| 2,979,153 | | 4/1961 | Hoagland et al. . | |
| 3,424,134 | * | 1/1969 | Rosenblum | 119/96 |
| 4,177,877 | | 12/1979 | Gallinati . | |
| 4,273,216 | | 6/1981 | Weissmann . | |
| 4,302,847 | | 12/1981 | Miles . | |
| 4,731,882 | | 3/1988 | Ekman . | |
| 5,136,724 | | 8/1992 | Grilliot et al. . | |
| 5,738,046 | | 4/1998 | Williams et al. . | |
| 5,960,480 | * | 10/1999 | Neustater et al. | 2/456 |
| 5,970,517 | | 10/1999 | Jordan . | |
| 6,035,440 | | 3/2000 | Woodyard . | |
| 6,101,631 | * | 8/2000 | Ferguson | 2/94 |
| 6,128,782 | * | 10/2000 | Young et al. | 2/69 |

FOREIGN PATENT DOCUMENTS 1 233 761 5/1971 (GB) .

* cited by examiner

*Primary Examiner*—John J. Calvert
*Assistant Examiner*—Tejash Patel
(74) *Attorney, Agent, or Firm*—Richard C. Litman

(57) ABSTRACT

A safety device for hunters, naturalists, and other outdoorsmen provides a camouflaged hunting garment which incorporates a safety harness into the body of a jacket, coat, or other apparel. The safety garment is made up of a safety harness with a central attachment ring for receiving a rope or line for releasably anchoring a wearer to an anchor point such as the trunk of a tree. The safety harness is sewn into the inside portion of the vest, jacket, or garment, fully covering the harness so that it is essentially invisible from the outside. In the event the harness is in use, such as during an accidental fall or when dragging a deer carcass, the pulling forces on the harness are equalized in both directions, providing maximally efficient distribution of force on the wearer.

8 Claims, 5 Drawing Sheets

HUNTING GARMENT WITH SAFETY DEVICE

CROSS-REFERENCE TO RELATED APPLICATION

This application claims the benefit of U.S. Provisional Patent Application Ser. No. 60/238,450, filed Oct. 10, 2000.

BACKGROUND OF THE INVENTION

1. Field of the Invention

The present invention relates generally to articles of clothing and more specifically to a safety garment for hunters.

2. Description of Related Art

Numerous articles of clothing have been devised for enhancing the safety of their wearers. Over the years, some of the most significant advances in the art have involved safety devices directly incorporated into a piece of clothing. However, none of the techniques described hereinbelow results in a hunting garment which incorporates a safety harness which allows hunters to reliably secure themselves to a tree or other support structure, particularly when the hunter is positioned at some height above the ground. Moreover, none of the references herein described presents a camouflage garment that addresses the need of hunters to be able to quickly put on the requisite safety gear when in the field. For example, U.S. Pat. No. 5,738,046, discusses a safety jacket and harness system, including a body harness formed by a pair of torso bands and a pair of shoulder straps. The torso bands form an upper torso band and a lower torso band. Each torso band has a fastening member attached to end portions. The pair of shoulder straps each has a first shoulder strap portion and a second shoulder strap portion. Each shoulder strap portion is coupled together by a fastening member. Included is a center strap that is fixedly attached to the torso bands and has a locking member at a top end. A safety strap has a first safety strap end that can couple with the locking member of the center strap, and a second safety strap end that can be looped and fastened around a tree trunk. An escape strap is attached to the safety strap. Lastly, a jacket receives the body harness when worn by a hunter using a tree stand with the center strap of the harness coupled to the safety strap looped around the trunk.

U.S. Pat. No. 5,970,517, issued to Jordan, discloses a harness assembly having an integral support line. The harness assembly includes a harness body having first and second ends that extend from the harness body. The harness is secured within a garment. The garment has a front opening which is normally covered by a releasable flap. The first and second ends of the support line extend through the front opening and are accessible when the flap is moved to an open position. The first end of the support line may be pulled away from the harness to extend the support line therefrom. The second end of the support line is secured to the harness.

U.S. Pat. No. 6,035,440, issued to Woodyard, discloses a safety vest which incorporates a safety harness between a vest inner lining and a vest outer shell with attachment couplers and rings incorporated in the vest in vest pockets that store the attachment couplers and rings out of sight in communicating between the harness and a lanyard external to the vest.

U.S. Pat. No. 2,979,153, issued to E. J. Hoagland et al., discloses a safety suit for supporting a person's body in an upright manner during hoisting including a garment arranged to extend around the torso of a body and a plurality of annularly extending straps defining body embracing nooses.

U.S. Pat. No. 4,177,877, issued to Gallinati, presents a vest adapted to be worn by a workman operating at perilous heights. The vest has straps between the lining and the outer fabric. The straps have crossed sections in the back of the garment and vertical sections in the front panels.

U.S. Pat. No. 4,273,216, issued to Weissmann, discloses a safety jacket adapted to have a line secured thereto for anchoring the wearer of the jacket in the event he loses his footing. The jacket includes a harness having a pair of shoulder straps and a belt made of polypropylene which is threaded through loops at the ends of the shoulder straps.

U.S. Pat. No. 4,302,847, issued to Miles, discusses a body protective clothing to be worn over or in place of outer garments for protection while actively participating in various sports. A zippered vest-type garment including a resilient foam insert along the lower portion of the torso includes adjustable front closure straps for maintaining the position of the foam about the lower back and hip bones.

U.S. Pat. No. 4,731,882, issued to Ekman, discloses a garment that is connectable to a safety line or the like and which includes at least one band, which is intended to take up the weight of a person wearing the garment.

U.S. Pat. No. 5,136,724, issued to Grilliot et al., relates to a firefighter's trousers and safety harness combination. At least a portion of the safety harness is positioned and supported within the firefighter's trousers.

British Patent No. 1,233,761 shows a safety harness having integral seat and jacket portions, the seat portion including couplers whereby the harness can be suspended from wires or ropes and the jacket portion including sufficient buoyancy to keep the wearer of the harness afloat if dropped into water.

None of the above inventions and patents, taken either singly or in combination, is seen to describe the instant invention as claimed.

SUMMARY OF THE INVENTION

The safety device for hunters, naturalists, and other outdoorsmen provides a camouflaged hunting garment which incorporates a safety harness into the body of a jacket, coat, or other apparel. The safety hunting garment allows hunters using elevated positions such as trees or tree stands to focus on the sport, instead of worrying about falling. The safety garment is made up of a safety harness with a central attachment ring for receiving a rope or line for releasably anchoring a wearer to an anchor point such as the trunk of a tree. The safety harness is sewn into the inside portion of the vest, jacket, or garment, fully covering the harness so that it is essentially invisible from the outside.

The harness includes a waist belt and matching belt coupler on the belt ends which may be releasably interlocked as a buckle. The belt ends extend out from under the inner lining of the safety garment, the inner lining in the preferred embodiment being selectively removable. An opening is provided in the upper midportion of the safety garment's back, defining a pocket which passes through the safety garment's outer shell and has associated with it a flap, which acts to cover or overlie the opening. A strap having an attachment ring securely fastened thereon and being of a length sufficient to pass from the harness through the opening to the outside of the safety garment outer shell is also provided. The pocket serves as a cavity in which the ring, as well as its associated strap, is stored during nonuse. The overlying flap preferably carries a camouflage pattern similar or the same as that covering the outer shell of the safety garment.

The harness includes a pair of shoulder straps or loops, each having respective ends attached to the waist belt and each forming front and back shoulder loop or strap portions. An important structural feature is that the back shoulder loop portions converge to intersect in the rear portion of the back to form a juncture connection. Underarm straps are also provided extending laterally to connect a respective pair of adjacent front and rear shoulder loop portions. Thus, the harness includes crossed back sections and vertical front sections. The crossed back sections are interconnected intermediate their ends in the juncture connection which is positioned intermediate the neck portion and the lower edge of the vest and medially between the sides. The safety strap is fixedly attached to the harness at this juncture and also at the waist belt at the point of intersection with the midline of the back. In the event the harness is in use, such as during a fall or when dragging a deer carcass, the pulling forces on the harness are equalized in both directions, providing maximally efficient distribution of force on the body harness.

Accordingly, it is a principal object of the invention to provide a hunting garment having a safety harness incorporated therein.

It is another object of the invention to provide a hunting garment whereby the placement of a hunter's safety harness may be easily and more comfortably worn and positioned for maximum positive effect.

It is a further object of the invention to provide a hunter's safety garment wherein the harness is designed to work in combination with the outer layer of the garment to increase the wearer's safety.

Still another object of the invention is to provide a camouflaged hunter's safety garment.

It is a further object of the invention to provide an improved camouflage garment, which maximizes a wearer's continuous concealment when in the field.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a safety device for hunters, naturalists, and other outdoorsmen by providing a combination camouflaged hunting garment and harness. The preferred embodiment of the invention is depicted in FIGS. 1–5 and generally referred to by the numeral 10.

Figure 1:
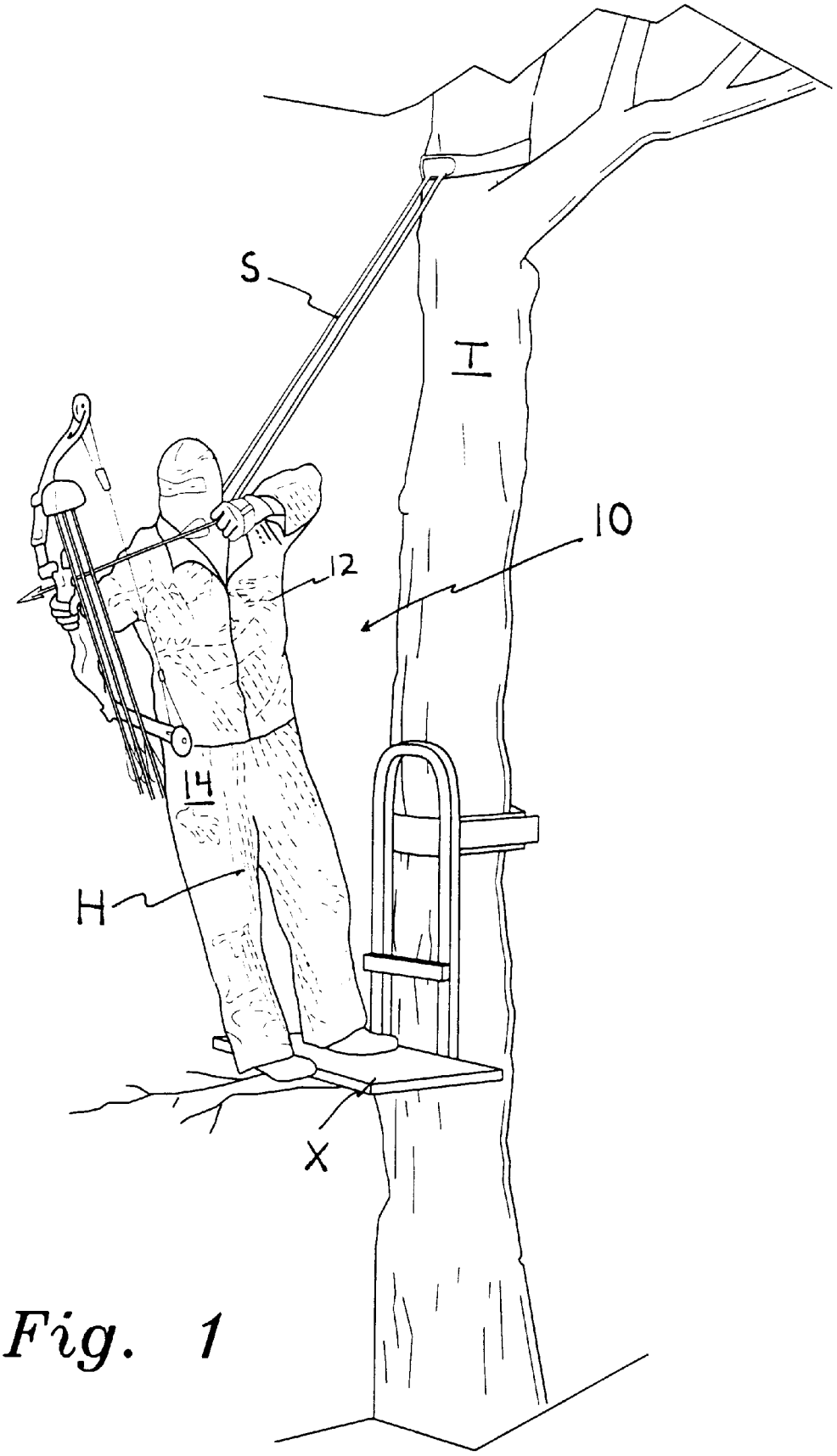
FIG. 1 is an environmental, perspective view of a hunting garment with safety device, according to the present invention.

As diagrammatically illustrated in FIG. 1, an environmental view in which a Hunter H is readying himself for the kill is shown. The hunter H, is shown wearing the safety camouflage garment 10. The hunter H is safely suspended from a tree T by a safety line S attached to the invention, which provides him with a stable and secure line to keep him from falling from his tree stand X in case of a misstep. The safety device for hunters 10, hereinafter also referred to as the "safety garment," allows the hunter H to focus on the sport, instead of worrying about falling.

Every year thousands of deer hunters are crippled, paralyzed, or even killed after falling from trees or elevated tree stands. Some statistics indicate that as many as two thirds of hunters fail to wear safety equipment when climbing or descending, or when entering or exiting their stands. While many hunters are aware of the safety advantages of wearing harnesses during climbing or when descending from a tree, they report that they fail to do so, because the harness gets in the way of the stand as they climb or they simply do not want to spend the time dealing with it. Commentators have observed that this complacency in hunters may come from a lifetime of having climbed trees and ladders without safety restraints, and then carrying over this behavior to the woods, where trees and tree stands are unstable and natural vegetation can provide an unrealistic sense of relative height above ground.

The International Hunter Education Association reported 19 deaths from tree stand falls in 1997, the last year for which statistics were available. Currently it is estimated that more than 37 percent of hunters using tree stands have fallen at least once. The present invention presents an excellent solution to this problem by providing a safety strap/harness which is incorporated directly into the body of a camouflaged hunting garment. And, as shown in FIG. 1, this can include any kind of apparel, such as a jacket 12, or a pair of trousers 14. Furthermore, any kind of harness may be used, though a preferred harness system is herein described.

In a recent report published from Wright-Patterson Air Force Base in Ohio, it was shown that volunteers suspended in mid air while wearing safety belts began to become unconscious anywhere from 30 seconds to up to 4.5 minutes, while test subjects wearing chest harnesses began to lose consciousness between one and 13 minutes. The present invention provides an important improvement by incorporating a safety harness directly into the structure of a hunting jacket, creating better distribution of pressure on the subject's torso in case of accidental fall.

The safety garment 10 of the present invention comprises a safety harness with a central attachment ring for receiving a rope or line for releasably anchoring a wearer of the safety garment to an anchor point such as the trunk of a tree. An important advantage of the safety garment 10, from both an aesthetic and practical viewpoint, is that it is sewn directly into the inside portion of the vest, jacket, or garment, fully covering the harness so that it is essentially not visible from the outside. By being tightly incorporated into the safety garment, the invention presents an important advantage in that it may be easily adapted to fit around a wearer's torso in the manner of putting on and suitably adjusting a conventional jacket to fit. Thus, the combination camouflaged jacket/safety harness is an important contribution to the art which provides an ideal level of safety and comfort to users.

Figure 2:
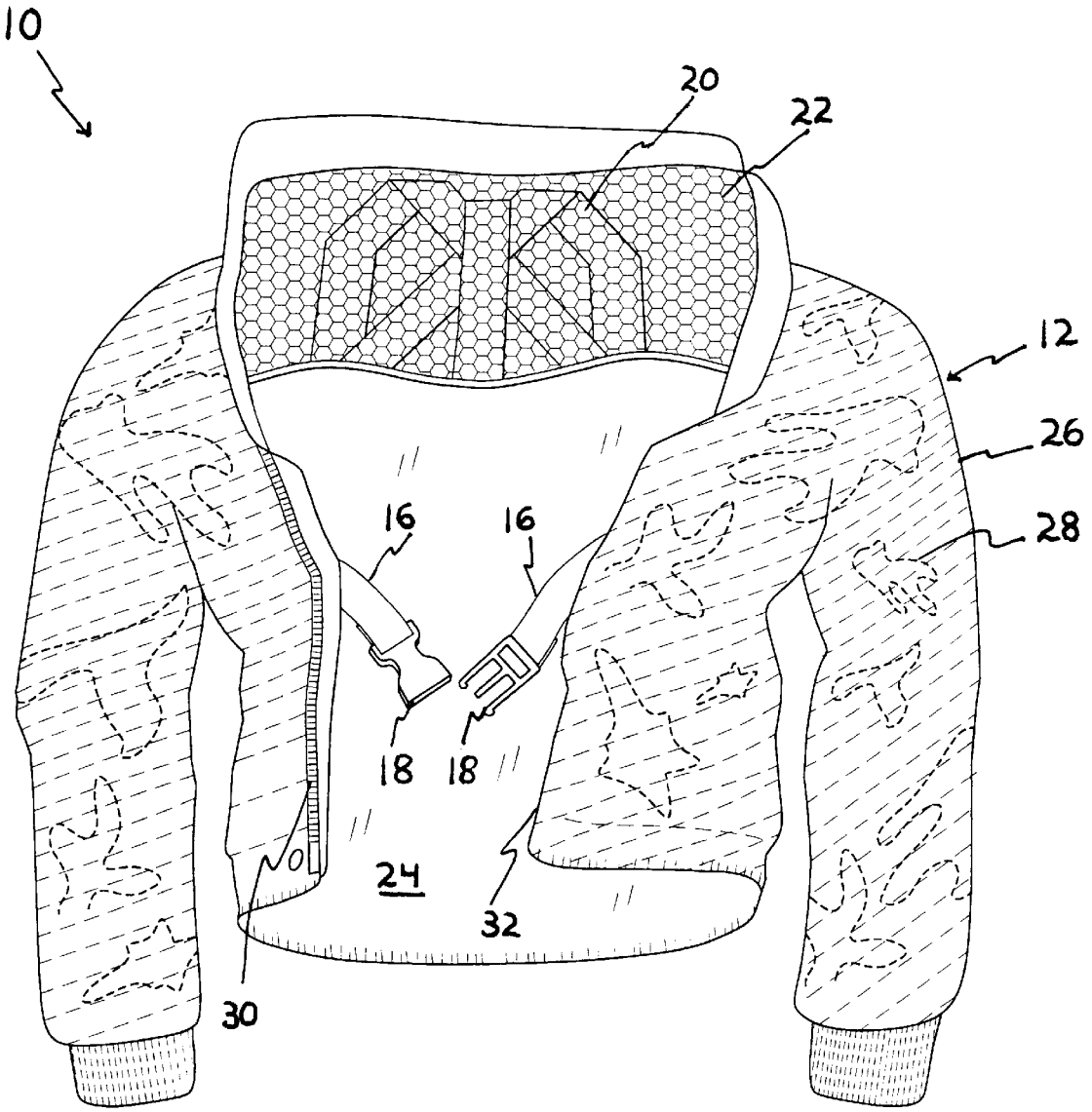
FIG. 2 is an exterior front view of the hunting garment with safety device, according to the present invention.

Referring now to FIG. 2, it can be seen that the jacket 12 includes a waist belt 16 and matching belt coupler 18 on the belt ends which may be releasably interlocked as a buckle. The belt couplers or buckle 18 are part of the harness 20 (partially obscured by the mesh netting indicated by 22) and also preferably made of plastic, which is much quieter than metal devices which can create noise and scare game animals. As shown, the belt 16 ends extend out from under the inner lining 24 of the safety garment 10, the inner lining 24 in the preferred embodiment being selectively removable. As explained in greater detail hereinbelow, the waist belt 16 is connected to the harness 20, the general arrangement of which, again, can be partially seen folded over itself through the netting 22. This netting 22 may form a portion of the inner lining 24 of the safety garment 10 or be entirely independent thereof. The netting 22 is preferably made of a mesh having a loosely knit construction to facilitate proper air and moisture ventilation. The outer shell 26 of the jacket 12 preferably has pockets with openings (not shown) in the outer shell 26 through which the ends of the waist belt 16 may pass from inside the safety garment 10 to the outside of the safety garment shell to provide a neat and sporty appearance. The present invention may also include an adjustable hood.

The conventional hunter's coat is less than ideal not only for the disruption and inconvenience it provides when having to put a separate safety harness on but also because of the problem which arises when human body odors, the detection of which is the first line of defense for many animals, are released into the environment when opening or taking off a garment, "spooking" game even after a hunter leaves the area.

Of course, these problems are not limited to hunters who like to stalk their game. Bird-watchers, who, commonly, want to see a wide array of species on an outing, will sometimes mount tree stands to get a better view. The present device allows a birdwatcher to quickly, safely, and "scentlessly" blend into the background, providing him an enormous advantage.

As seen in FIG. 2, adjacent and along a line substantially parallel to the seam line is a zipper, generally 30, for reversibly attaching to mating elements (not shown) approximately located adjacent mating seam line 32. It should be understood that though specific fastening elements are described for the preferred embodiment, fasteners of any kind or combination commonly known in the art and in conventional usage may be substituted.

The invention provides another important advantage in that it is camouflaged. Camouflage indicia, indicated by ghost lines 28, covers the exterior surface of the outer shell 26 of the jacket 12. Moreover, any camouflage pattern may be used, though the invention is best suited to camouflage patterns which represent leafy, woody, or forest areas. In the present invention, when on sale, the suit 10 may be provided with an assortment of camouflage patterns, such as moss-covered oak or wetlands, common themes for camouflage found in stores across the nation. In the preferred embodiment, the camouflage pattern would completely cover the garment 10, though in alternative embodiments, the garment 10 may be provided with camouflage only in particular areas, such as the hood, arms, and chest. These patterns may be designed to cover only a certain portion of these areas. This specification also embraces indicia which are outside of the visible human spectrum, as some animals such as deer may be able to detect objects in the ultraviolet spectrum, especially in low light conditions.

Figure 3:
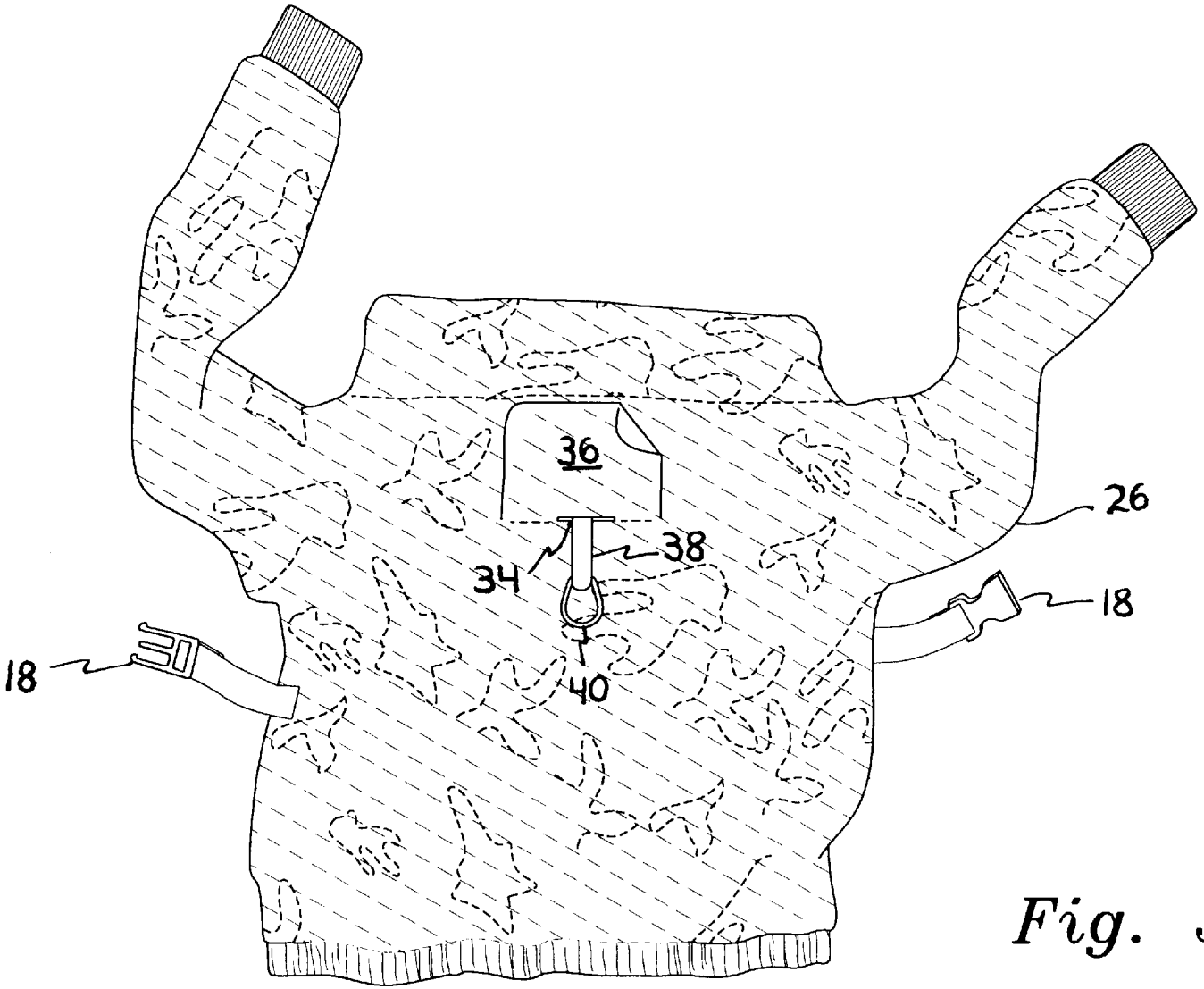
FIG. 3 is an exterior rear view of the hunting garment with safety device, according to the present invention.

Turning now to FIG. 3, an opening 34 is provided in the upper midportion of the safety garment's 10 back, defining a pocket which passes through the safety garment's outer shell 26 and has associated with it a flap 36, which acts to cover or overlie the opening 34. A safety strap 38 having an attachment ring 40 securely fastened thereon and being of a length sufficient to pass from the harness (not shown) through the opening 34 to the outside of the safety garment outer shell 26 is also seen. The pocket serves as a cavity in which the ring 40, as well as its associated strap 38, are stored during nonuse. The overlying flap 36 preferably carries a camouflage pattern similar to or the same as that covering the outer shell 26 of the safety garment 10. The opening 34 is normally covered by the flap 36, which is preferably releasable.

In the preferred embodiment, the outer shell 26 of the jacket 12, along with the harness 20, and the inner lining 24 may be laundered separately, allowing the outer shell 26 to be infrequently cleaned, thereby protecting the clarity of the particular camouflage patterns from washout. This attribute responds to the long felt problem in the art of camouflage patterns becoming less distinct and more blurry after being cleaned, sometimes even after just a few washes, making them significantly less effective.

Some importance should be ascribed to the material out of which the outer layer 26 is made. Preferable materials, thus, would be synthetic textiles, such as polyester or polyamide materials. Alternatively, more conventional materials may be used having synthetic filaments incorporated therein for strength and flexibility.

Ideally, the material out of which the entire suit 10 is made would be quiet upon movement to allow for efficient stalking of game or bird watching. The inner layer or shell 24 could be made of any suitably durable substance, including cotton, wool, polymeric material, a synthetic blend or even a lightweight polyester fabric for easy carrying and storage. In alternative embodiments, the outer layer 26 may also have draw cords for a more snug fit, as well as elastic throughout. The entire garment 10 should be machine washable and may include different sized mesh backing 22 to allow for air flow while preventing the ingress of insects.

Figure 4:
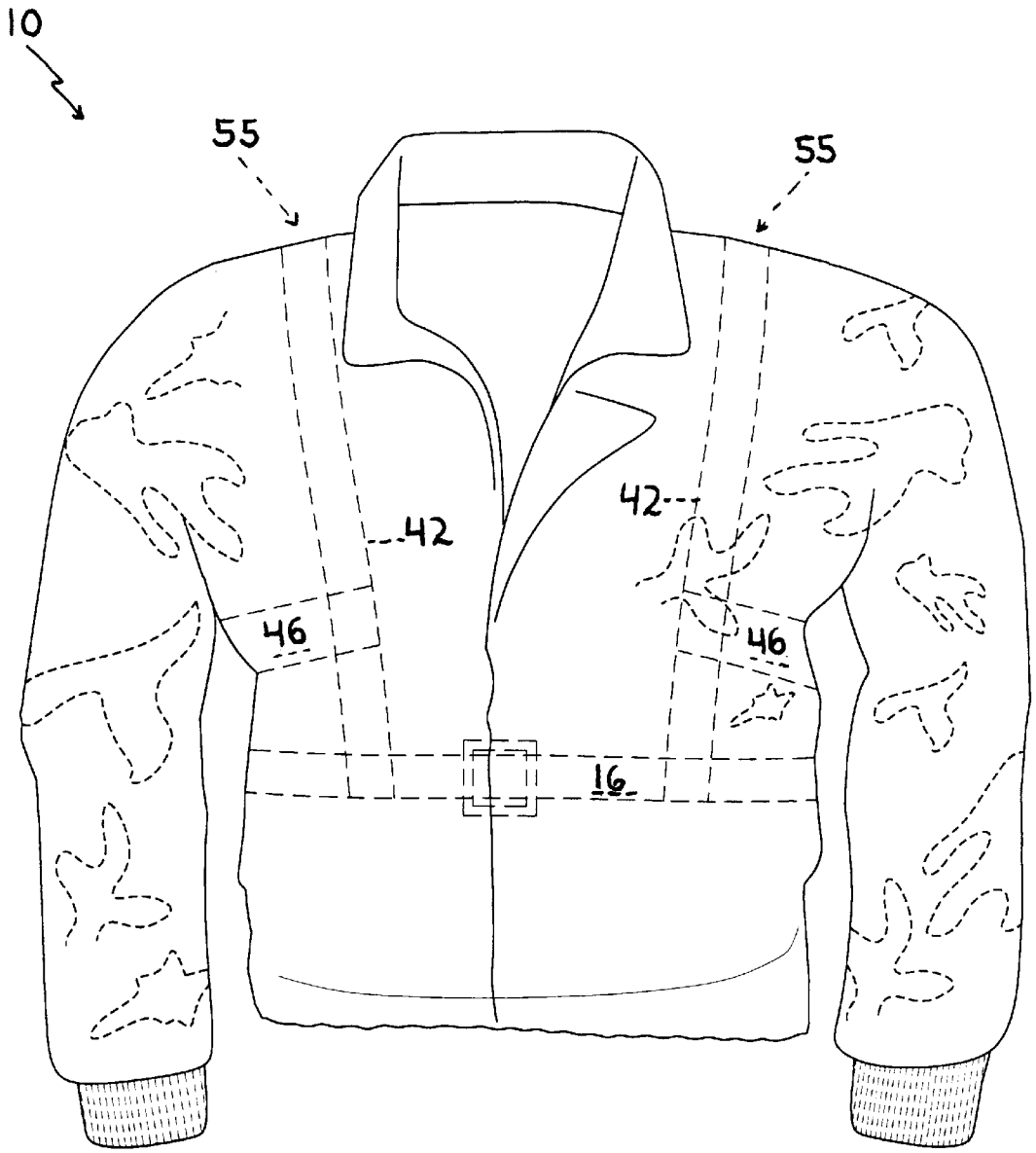
FIG. 4 is a front view of the hunting garment with safety device, showing the front portion of the harness in ghost lines, according to the present invention.
Figure 5:
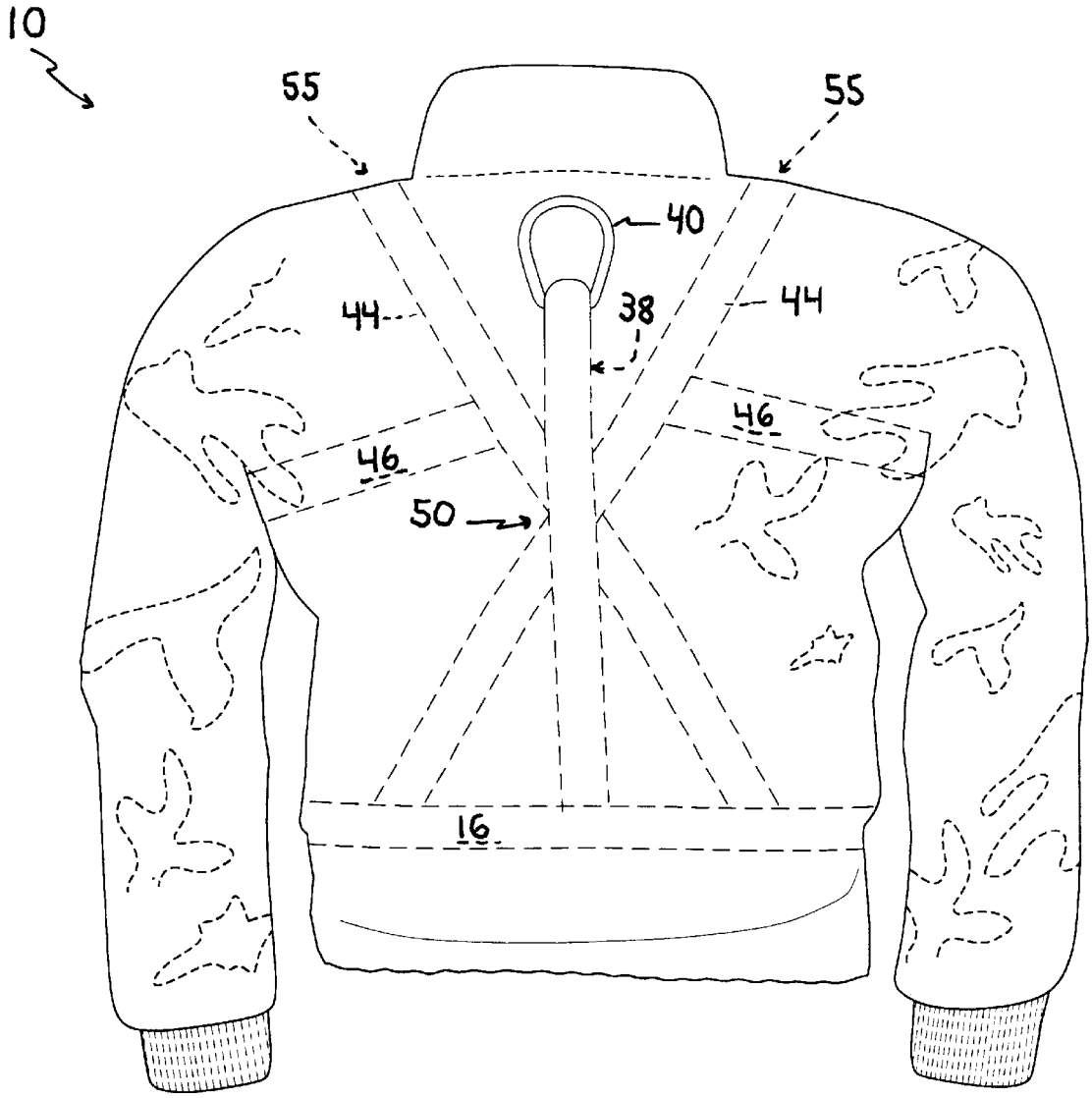
FIG. 5 is a rear view of the hunting garment with safety device, showing the rear portion of the harness in ghost lines and with the flap removed, according to the present invention.

Turning now to FIGS. 4–5, showing the front and rear portions of the harness 20 in ghost lines, it can be seen that the harness 20 includes a pair of shoulder straps, each generally 55 and having strap ends attached to the waist belt 16, and each forming a front shoulder loop portion 42 and a back shoulder loop portion 44, disposed over the wearer's shoulders. An important structural feature is that the back shoulder loop portions 44 converge to intersect in the rear portion of the back, substantially as shown. Under arm straps 46 are also provided extending laterally to connect a respective pair of adjacent front 42 and rear 44 loop portions, substantially as shown. Thus, the harness 20 includes crossed back sections and vertical front sections. The crossed back sections are interconnected intermediate their ends in a juncture connection 50 which is positioned intermediate the neck portion and the lower edge of the vest and medially between the sides. The safety strap 38 is fixedly attached to the harness 20 at this juncture 50 and also at the waist belt 16 at the point of intersection with the midline of the back.

In the event the harness 20 is in use, such as during a fall or when dragging a deer carcass, the pulling forces on the harness 20 are equalized in both directions, providing maximally efficient distribution of force on the body harness 20. The structure of the safety garment 10 together with the structure of the harness 20 assure a proper positioning of the straps 55 during wear. Thus, when the safety garment 10 is in use, the safety system is also initiated (once the front buckle or clasp is closed) in contrast to the conventionally used systems, that use two separate pieces—a safety harness and a garment alone. However, it should be understood that although the structure of the harness 20 is particularly well suited for the physical requirements described herein, this specification embraces any structural design for the harness 20 wherein a camouflaged article of clothing has a harness incorporated within.

In addition to the above mentioned structural characteristics, the safety garment may also be provided with pockets, or any other conventional accouterment typically associated with apparel, especially that used for hunting. The various pockets include the front waist pockets with openings in the outer shell 26 through which the waist belt ends 18 may pass from inside the safety garment to the outside of the safety garment shell 26. The product line also includes any and all variations in size and design, such as parkas, heavy coats, rain jackets, wind breakers, vests and the like, for both portly men and women, and children. And so in alternative embodiments, the safety garment 10 may be in the form of overalls or a one piece jacket and trousers, as well as other conventionally known garments, such as a hoodless jacket, vests, shirts, pants, and headgear or any combination thereof.

Now it may be understood how a user would implement the safety garment 10 in the field; whenever a hunter H would wish to use the invention to support himself, he would need only to casually reach over his back, lifting the flap 36, to pull out the ring 40, neatly stored just inside the safety garment 10 and manually accessible. The ring 40, which is preferably made of steel coated with rubber, can then be easily attached to a safety line. The safety device 10 could then be easily engaged before mounting a tree stand, the nylon straps of the harness 20 being sufficiently strong and the safety strap 38 being of sufficient length to allow for maximum convenience for the wearer.

Although camouflage garment patterns are preferred, the inventive garment may include any color and color patter, e.g. solid color such as blaze orange, etc.

The harness is preferably sewn inside the jacket, i.e., between the liner and the outer shell, but alternative arrangements are contemplated by the present invention, such as attachment of the harness inside the jacket to the inner liner using adhesive or stitching, or allowing the harness to be free of connection to either garment portion.

It is further contemplated by the invention that a pre-existing safety harness system may be inserted between the jacket and the liner in any manner described above.

It is to be understood that the present invention is not limited to the sole embodiments described above, but encompasses any and all embodiments within the scope of the following claims.

I claim:

1. A hunting safety garment comprising:

an outer layer, an inner layer, and a safety harness;

said outer layer having camouflage indicia disposed thereon and said inner said inner layer being selectively removable from the garment;

said safety harness being secured to the interior of said outer layer, said safety harness including a belt portion for extending around a user's waist, a pair of shoulder loops for extending over a wearer's shoulders and defining front and back shoulder loop portions, said back loop portions being crossed and forming a juncture connection intermediate their ends;

said safety harness further comprising a safety strap securely fastened to said juncture connection and to said belt portion located at approximately the spine of the wearer;

said safety strap being reversibly extendible through an opening located in said outer layer of said garment, and having a safety ring securely fastened to the free end thereof;

said safety ring being adapted for reversibly coupling with a safety line.

2. The hunting safety garment of claim 1, further comprising a flap located on said outer layer in the vicinity of said outer layer opening.

3. The hunting safety garment of claim 2, wherein said safety strap and said ring are selectively covered by said flap, said flap being secured to said outer layer, said flap including camouflage indicia.

4. The hunting safety garment of claim 1, wherein said inner layer comprises a mesh of loosely knit construction to allow for air and moisture circulation.

5. The hunting safety garment of claim 1, in combination with a support means, wherein said support means may be selected from the group consisting of a support line, a belt, a cable, a rope, and a cord.

6. The hunting safety garment of claim 1, in combination with a structure upon which a user may stand to provide for increased height.

7. A hunting safety garment comprising:

an outer layer, an inner layer, and a safety harness;

said outer layer having camouflage indicia disposed thereon and said inner said inner layer being selectively removable from the garment;

said safety harness being secured to the interior of said outer layer;

said safety harness comprising a belt portion for extending around a user's waist, a pair of shoulder loops for extending over a wearer's shoulders and defining front and back shoulder loop portions, said back loop portions being crossed and forming a juncture connection intermediate their ends;

said safety harness further comprising a safety strap securely fastened to said juncture connection and to said belt portion located at approximately the spine of the wearer, said safety strap being reversibly extendible through an opening located in said outer layer of said garment and having a safety ring securely fastened to the free end thereof, said safety ring being adapted for reversibly coupling with a safety line;

said safety garment further comprising a flap located on said outer layer in the vicinity of said outer layer opening;

said safety strap and said ring being selectively covered by said flap, said flap being secured to said outer layer, said flap including camouflage indicia; said inner layer including a mesh of loosely knit construction to allow for air and moisture circulation.

8. The hunting safety garment of claim 7, wherein said garment is selected from the group consisting of a jacket, a parka, a rain jacket, a coat, a wind breaker, and a vest.

* * * * *